US006394568B1

(12) United States Patent
Menéndez

(10) Patent No.: US 6,394,568 B1
(45) Date of Patent: May 28, 2002

(54) STRUCTURE FOR ADJUSTING PRINTHEAD TO PLATEN SPACING IN A PRINTER AND RELATED METHODS

(75) Inventor: Jorge Menéndez, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/484,185

(22) Filed: Jan. 18, 2000

(51) Int. Cl.[7] ..... B41J 25/308; B41J 23/00
(52) U.S. Cl. ..... 347/8; 347/37
(58) Field of Search ..... 347/8, 4, 9, 19, 347/37, 38, 14, 23, 2

(56) References Cited

U.S. PATENT DOCUMENTS

| | | | | |
|---|---|---|---|---|
| 5,000,590 A | | 3/1991 | Einem | 400/55 |
| 5,195,836 A | | 3/1993 | Longust et al. | 400/354 |
| 5,570,959 A | | 11/1996 | Moriwaki et al. | 400/56 |
| 5,815,171 A | | 9/1998 | Brugue | 347/8 |
| 6,219,082 B1 | * | 4/2001 | Rumsey et al. | 347/242 |

* cited by examiner

*Primary Examiner*—John Barlow
*Assistant Examiner*—Charles W. Stewart, Jr.
(74) *Attorney, Agent, or Firm*—Skjerven Morrill MacPherson LLP; James E. Parsons; Christopher B. Eide

(57) ABSTRACT

A printer and components of the printer are described, along with methods of adjusting and using the printer. The printer includes a carriage that supports at least one printhead. The at least one printhead ejects ink onto a print media that is fed though a space between the printhead and a platen as the carriage moves laterally along slider rods supported by a beam. The space between the at least one printhead and platen is adjusted along the length of the printing path by applying a bending force to the underside of the beam that raises or lowers the beam relative to the platen at selected points. The adjustment is effected by one or more adjustment assemblies that abut the lower surface of the beam. In one embodiment, the first adjustment is an acorn nut and the second adjustment a differential screw that is engaged with the acorn nut. Rotation of the acorn nut effects a rough adjustment of the printhead to platen spacing, and rotation of the differential screw effects a fine adjustment of the printhead to platen spacing.

29 Claims, 6 Drawing Sheets

STRUCTURE FOR ADJUSTING PRINTHEAD TO PLATEN SPACING IN A PRINTER AND RELATED METHODS

FIELD OF THE INVENTION

The present invention relates to a printer, and in particular to an ink jet printer typically used in association with a computer.

BACKGROUND OF THE INVENTION

A parameter of ink jet printers is the spacing (i.e., distance) between the printhead and the platen upon which the print media advances. A typical spacing between the printhead and the platen is 1.20 mm. This spacing must be constant, within a tolerance of, for example, +/−0.15 mm, along the entire printing path of the printhead to obtain uniform printing. For large format printers, it is a challenge to maintain the spacing between the printhead and the platen within a tolerance of +/−0.15 mm or less because a typical length of the printing path is 1.5 m or larger.

A conventional printer includes a carriage that supports the printhead above the platen. The carriage moves laterally along one or two steel rods. In the past, practitioners formed the rods to be as straight as possible in order to maintain the amount of variation in the printhead to platen spacing within a specified range along the printing path.

Another solution is described in U.S. Pat. No. 5,195,836. The '836 patent discloses a guideway and support structure for a carriage. The guideway includes two rods. The rods are not necessarily pre-straightened, but rather are bent straight to the required tolerance as the rods are attached to and held by the support structure.

An ENDCAD printer employs a different approach. The ENDCAD printer comprises carriage that moves on a single rod. Equally spaced along the rod are two adjustment screws that are perpendicular to the rod. The opposing ends of each screw are threaded. The two threads of each screw are the same pitch. The upper end of each screw engages a hole in the lower part of the rod. The opposite lower end of each screw engages a hole in an chassis member located beneath the rod. Rotating a screw moves the rod a distance equal to two times the thread pitch, since there are two equal threads on the screw. Neither of the two screws are differential screws.

SUMMARY OF THE INVENTION

Embodiments of the present invention allow for greatly reducing the amount of variation in the spacing between a printhead and a platen along the length of a printing path of a printer. In particular, the present invention allows very precise adjustments of the printhead to platen spacing. Prior art solutions, including the ENDCAD system described above, do not allow the easy and fine adjustments enabled herein.

One embodiment of the present invention includes a printer having a printhead, a platen spaced from the printhead, and a carriage that moves the printhead laterally adjacent to the platen. The carriage travels on a pair of rods supported by a beam. One or more adjustment assemblies are located beneath and along the length of the beam. Each adjustment assembly applies selected amounts of bending force to the lower side of the beam, and thereby raises or lowers the beam and the rods relative to the platen at that point. Accordingly, there is a corresponding change in the printhead to platen spacing at that point. The printhead to platen spacing along the length of the printing path may be maintained within a specified range by appropriate adjustment of each of the adjustment assemblies.

In one embodiment, each adjustment assembly includes a U-shaped member having a central plate that abuts the lower surface of the beam. The adjustment assembly also includes a first adjustment co-located with a second adjustment. The first adjustment is an acorn nut having a rounded surface that abuts the central plate of the U-shaped member, and the second adjustment is a differential screw that is engaged with the acorn nut. The differential screw has two threads of a different pitch. One thread is engaged with the acorn nut, and the other thread is engaged with a base plate of the adjustment assembly. The amount of adjustment caused by rotation of the differential screw is the difference between the pitch of the two threads. The acorn nut and the differential screw have a common vertical axis that is aligned with a centroid of the beam, which allows the application of vertical force to the beam without the introduction of rotational forces.

These and other objects, features and advantages of the present invention will be more readily apparent from the figures and the detailed description of the exemplary embodiments set forth below.

BRIEF DESCRIPTION OF THE DRAWINGS

The use of the same reference symbols in different drawings indicates similar or identical items.

DETAILED DESCRIPTION

Figure 1:
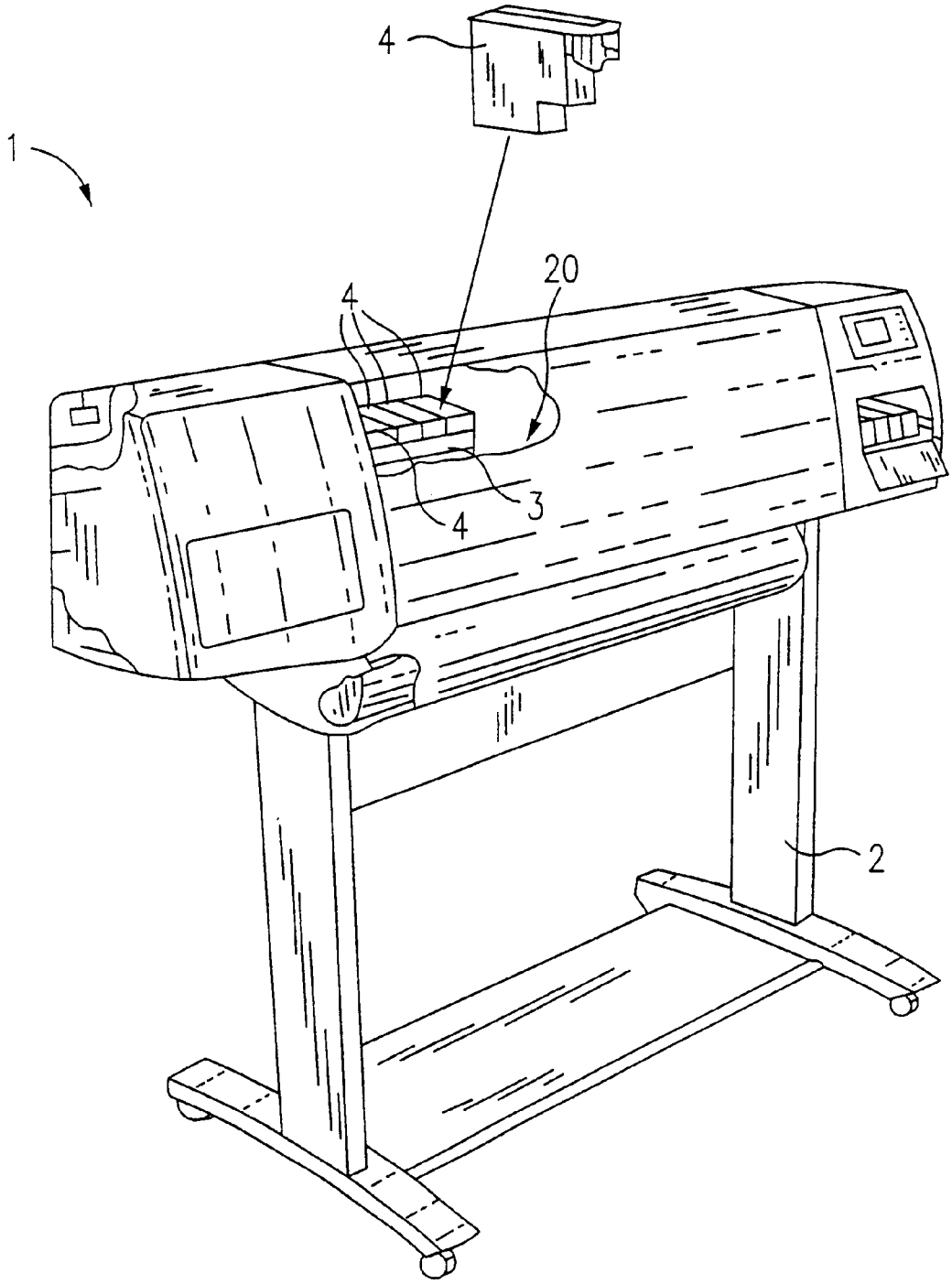
FIG. 1 is a perspective view of a printer 1.

FIG. 1 shows a printer 1 having an internal chassis (not shown) that is supported by a pair of spaced legs 2. Printer 1 includes a plurality of printheads 4 mounted on a transversely moveable carriage 3. In one embodiment, carriage 3 supports six ink jet printheads. The number of printheads can vary. An internal portion 20 of the chassis of printer 1 is shown in FIGS. 2 and 3.

Figure 2:
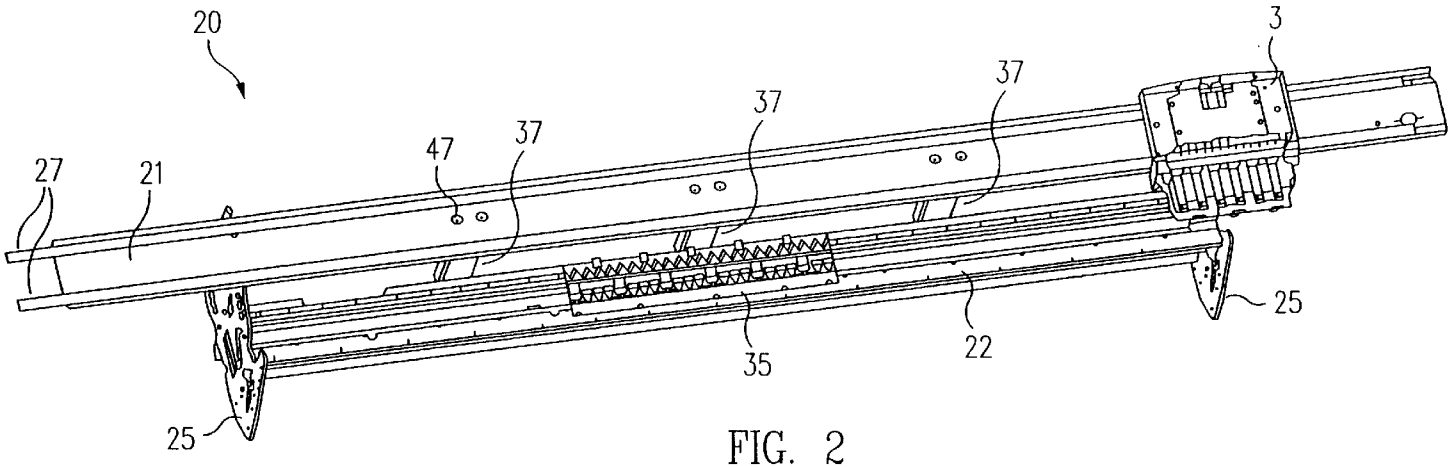
FIG. 2 is a perspective view of an internal portion 20 of the chassis of printer 1.
Figure 3:
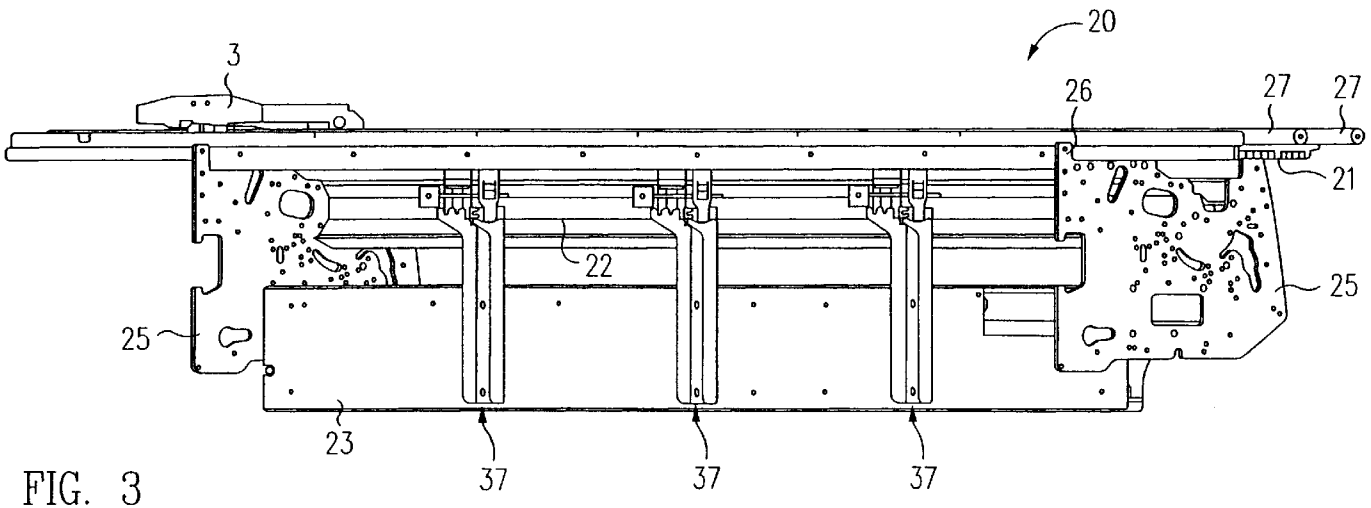
FIG. 3 is a perspective rear view of chassis portion 20 of FIG. 2, which depicts three adjustment assemblies 37 located beneath beam 21.
Figure 4:
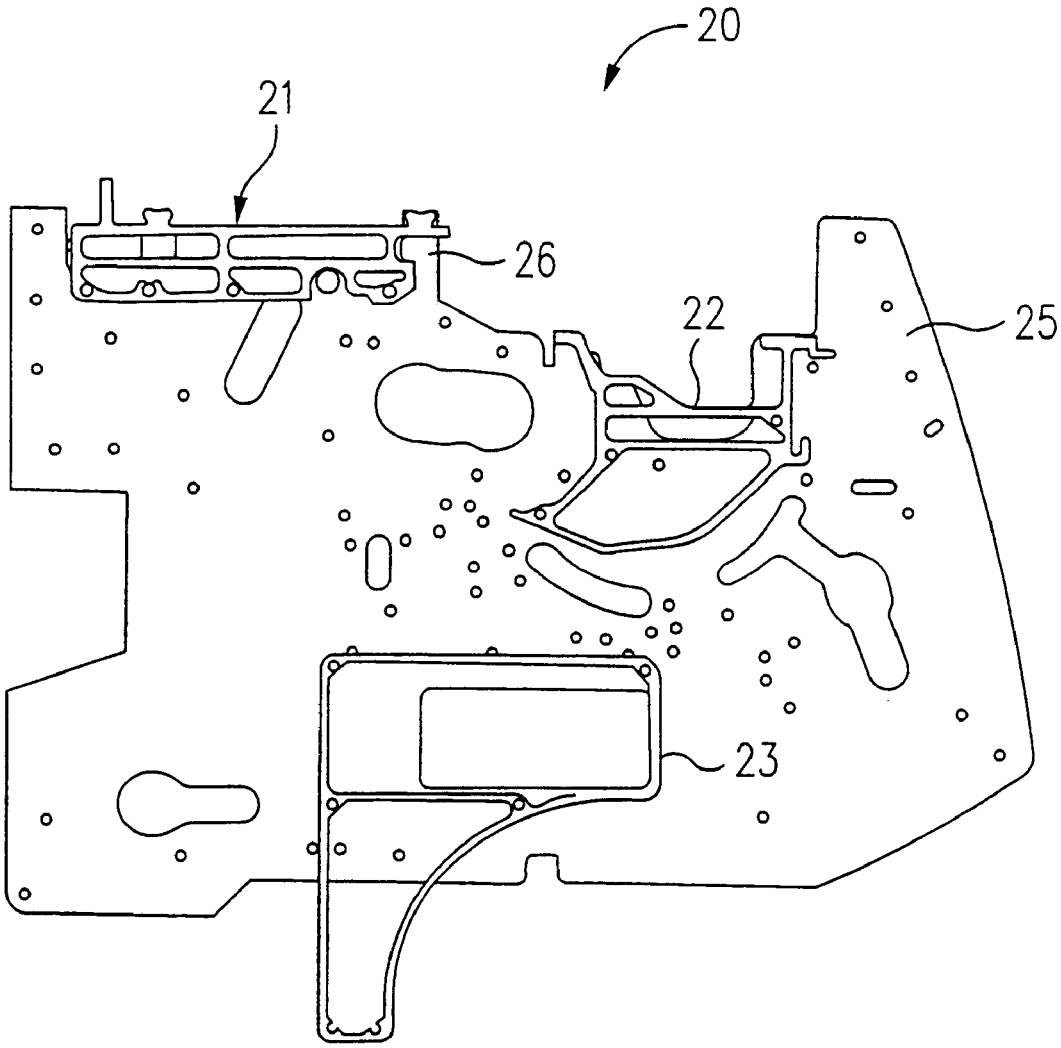
FIG. 4 is a side view of the connections of beams 21, 22, and 23 to side plates 25 of chassis portion 20.

Chassis portion 20 of FIGS. 2 and 3 includes three support beams 21, 22, and 23. Beams 21, 22, and 23 are supported by and extend between two side plates 25. FIG. 4 shows the connections between beams 21, 22 and 23 and one of the side plates 25. Beams 21, 22, and 23 are formed of extruded aluminum, and side plates 25 are formed of stamped aluminum plate.

Beam 21 is the printer carriage beam. Beam 21 has two sets of bushing supports 24. Each set of bushing supports 24 supports one of the two parallel steel rods 27 upon which carriage 3 travels. Each bushing support 24 has a generally V-shaped cross-section that serves to precisely locate the respective rod 27 relative to beam 21.

Rods 27 are fixed to beam 21 in a manner that allows thermal expansion and contraction of the rods in the lateral direction, without allowing orthogonal movement of rods 27 relative to beam 21. To satisfy this requirement, each rod 27 is attached at spaced intervals to its respective bushing supports 24 by means of a shoulder screw that enters into a threaded hole in the lower portion of the rod through a corresponding hole in the respective support 24. Springs are provided on the shafts of the screws. A total of eight such screws are engaged with each rod 27. Two of the screws are located near the lateral center of the rod. The six remaining screws are spaced along the length of the rod. For those six screws, the screw hole in the respective support 24 is elongated to allow the above-described lateral expansion and contraction of the rod. Fingers 26 (FIG. 4) of side plates 25 also support rods 27.

Figure 5:
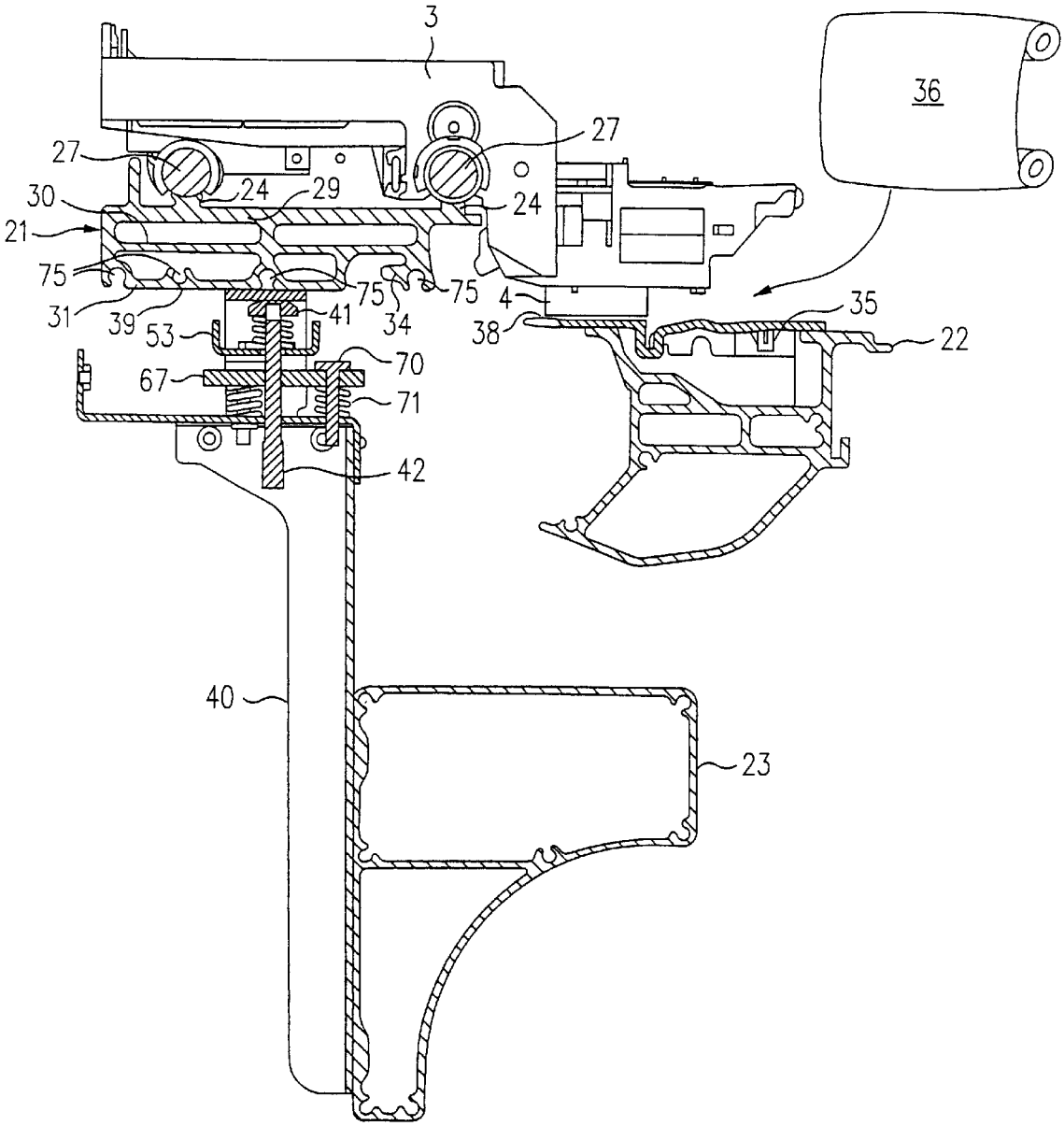
FIG. 5 is a cross-sectional side view of an adjustment assembly 37.

As shown in FIG. 5, beam 21 has a cross-section with three main horizontal limbs 29, 30, and 31, and a side portion 34 adjacent to limb 31. Limb 31 and side portion 34 are omitted beyond side plates 25. Screws (not shown) attach side plates 25 to screw holes 75 in limb 31 and side portion 34 of beam 21 (FIG. 4).

In one embodiment of a printer 1, beam 21 has a length of 1.595 m between side plates 25 and a total length of 2.028 m. Such a printer can print on paper having widths of up to 1.54 m.

Referring to FIGS. 2–5, beam 22 is a printing beam that also is connected between side plates 25. Beam 22 supports a grooved platen 35 (shown in part in FIG. 2) over which the paper 36 (FIG. 5) or other print media travels during printing. The grooves allow vacuum to be applied to paper 36 so as to hold the paper against platen 35. The main paper drive roller (not shown) is arranged to be located to the left of beam 22.

Beam 23 is the lower beam of the chassis, and also is supported between side plates 25. As shown in FIG. 5, beam 23 has a relatively large cross section, and thus provides strength and stiffness.

Referring to FIG. 3, three adjustment assemblies 37 are connected between beams 21 and 23. Adjustment assemblies 37 are located beneath beam 21 and behind beam 23. Adjustment assemblies 37 are evenly or almost evenly spaced along the length of beam 21 between side plates 25. Each adjustment assembly 37 is connected to beam 21 by two screws 47 (FIG. 2).

Figure 7:
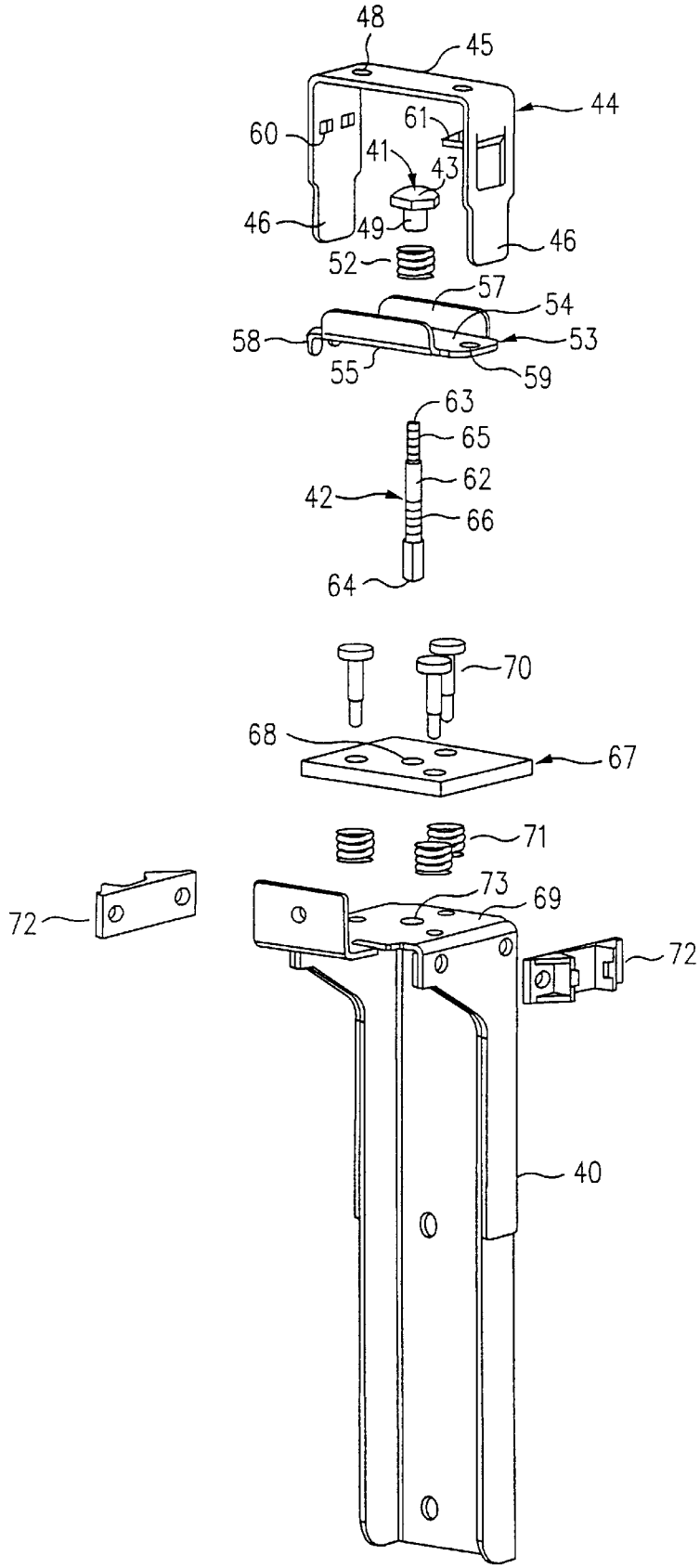
FIG. 7 is an exploded view of adjustment assembly 37.

The number and location of adjustment assemblies 37 can vary. The minimum is one adjustment assembly 37. Alternative embodiments may include two or four adjustment assemblies 37. Adjustment assembly 37 is made of steel, except for guides 72 (FIG. 7). Guides 72 are molded polycarbonate.

FIG. 5 is a cross-sectional view of chassis portion 20 of FIG. 2. Carriage 3 travels on rods 27. Carriage 3 supports printheads 4 adjacent to and above platen 35. Platen 35 is supported by beam 22. A small vertical space 38 is between printheads 4 and platen 35. Paper 36 passes through space 38 on platen 35.

Adjustment assembly 37 of FIG. 5 is connected between a planar lower surface 39 of beam 21 and beam 23. A lower portion of adjustment assembly 37 includes a bracket 40. Bracket 40 is connected to beam 23.

Adjustment assemblies 37 are used to apply a point force that bends beam 21 and rods 27 relative to platen 35 at the location of the particular adjustment assembly 37. Beam 21 and rods 27 are thereby raised or lowered relative to platen 35. By iteratively adjusting each adjustment assembly 37, the height of space 38 between printheads 4 and platen 35 can be adjusted so as to set the height of space 38 at a relatively constant value (e.g., +/−0.15 mm or less) along the entire length of the printing path to achieve uniform printing.

Figure 6:
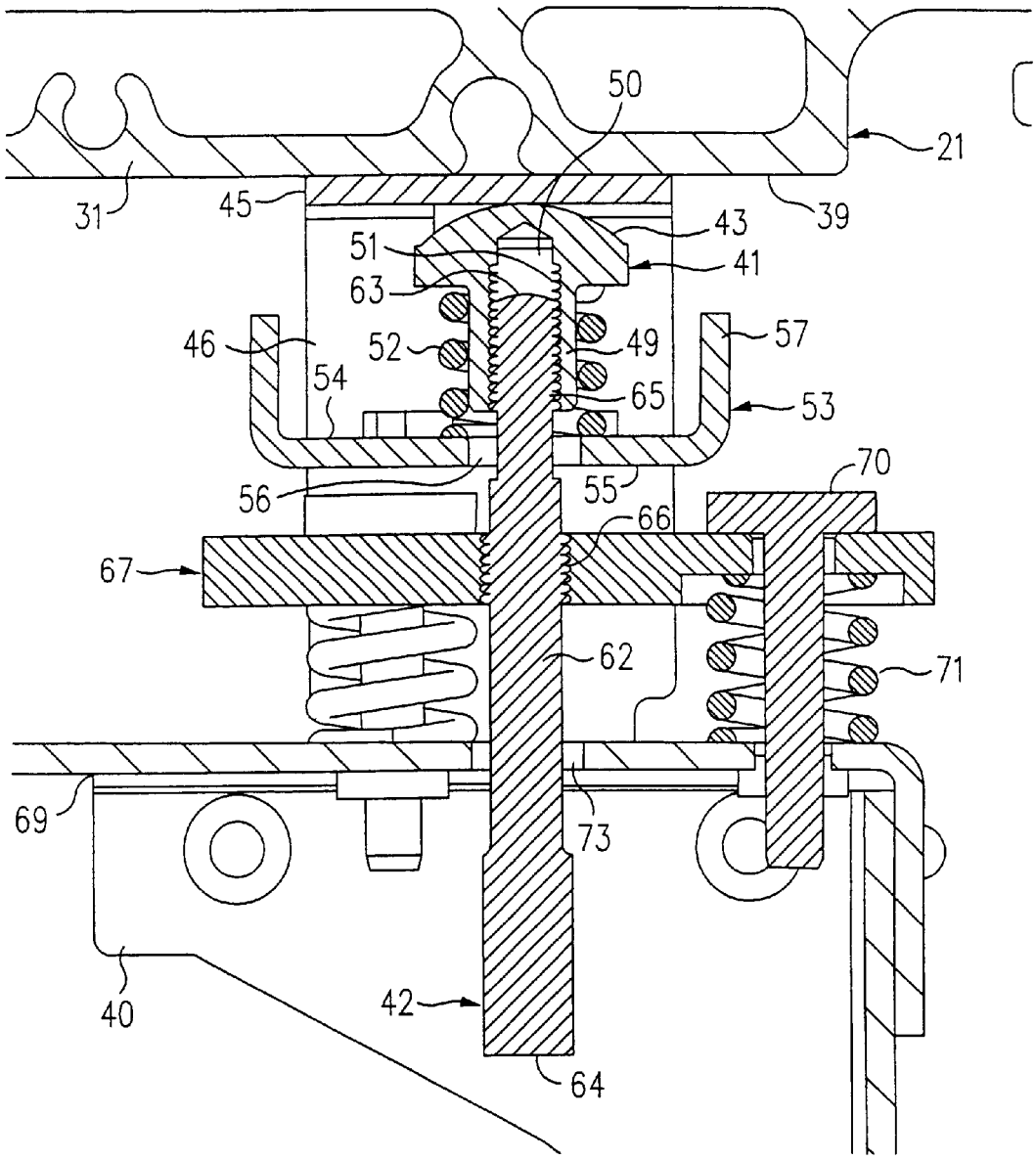
FIG. 6 is a cross-sectional side view of an upper portion of adjustment assembly 37 of FIG. 5.

FIG. 6 is a cross-sectional side view of an upper portion of adjustment assembly 37 between bracket 40 and lower surface 39 of beam 21. As shown, adjustment assembly 37 includes two rotatable adjustments having a common vertical axis: (1) an acorn nut 41 and (2) a differential screw 42. Rotation of acorn nut 41 and/or differential screw 42 causes a selected amount of orthogonal force to be applied to beam 21, thereby raising or lowering beam 21 and rods 27 relative to platen 35 at that point.

Acorn nut 41 has a rounded surface 43 that abuts a planar central portion of a U-shaped member 44 (see FIG. 7) opposite beam 21. The common central vertical axis of acorn nut 41 and differential screw 42 is aligned with a centroid (i.e., center of gravity) of beam 21. The rounded surface 43 on acorn nut 41 allows the alignment and application of force to beam 21 and U-shaped member 44 without the introduction of moments that would produce an unwanted twist or bend of beam 21 as acorn nut 41 or differential screw 42 are rotated.

FIG. 7 is an exploded view of an adjustment assembly 37. Beginning at the top of FIG. 7, adjustment assembly 37 includes a U-shaped member 44. U-shaped member 44 includes a planar central plate 45 and two opposing tongues 46 that are perpendicular to central plate 45.

Referring to FIGS. 5–7, an upper surface of central plate 45 of U-shaped member 44 abuts a planar lower surface 39 of beam 21. Central plate 45 includes two holes 48 (FIG. 7). Screws 47 (FIG. 2) pass through holes 48 and connect central plate 45 to beam 21. Rounded surface 43 of acorn nut 41 abuts a lower surface of central plate 45 opposite beam 21.

Referring to FIGS. 6 and 7, acorn nut 41 includes a shaft 49 that is opposite rounded surface 43. Shaft 49 of acorn nut 41 is hollow, and includes a central opening 50 (FIG. 6). Inner threads 51 are on the walls of central opening 50. In the present embodiment, inner threads 51 are M4, right hand. The pitch of inner threads 51 is 0.7 mm.

Shaft 49 of acorn nut 41 extends through spring 52. Spring 52 rests on a support member 53. Spring 52 provides compliance, allows for tolerance stacks, and is useful to withstand shock and vibration loads. Acorn nut 41 is supported from below by differential screw 42.

Referring to FIG. 7, support member 53 includes a planar first surface 54 upon which spring 52 rests, and an opposite planar second surface 55 that faces base plate 67. Differential screw 42 extends through a central hole 56 (FIG. 6) in support member 53. Support member 53 also includes two orthogonal upward extensions 57 that provide rigidity and prevent spring 52 from slipping during assembly. Support member 53 also includes two orthogonal downward extensions 58 and a hole 59 opposite extensions 58. Extensions 58 extend through rectangular holes 60 in left tongue 46 of U-shaped member 44. A screw (not shown) extends through hole 59 and attaches support member 53 to a corresponding hole in a horizontal flap 61 extending from right tongue 46 of U-shaped member 44.

Referring to FIGS. 6 and 7, differential screw 42 is engaged with threads 51 of acorn nut 41. Differential screw 42 includes a shaft 62 having an upper first end 63 and an opposite lower second end 64. Shaft 62 includes first threads 65 (FIG. 7) beginning at first end 63. First threads 65 are engaged with inner threads 51 (FIG. 6) of acorn nut 41, and accordingly have the same pitch. Shaft 62 is hexagonal-shaped at second end 64 to accommodate a wrench. An intermediate portion of shaft 62 of differential screw 42 includes second threads 66 (FIG. 7). In the present embodiment, second threads 66 of shaft 62 are M5, right hand. The pitch of second threads 66 is 0.8 mm. Second threads 66 are engaged with complimentary threads on the walls of a hole 68 (FIG. 7) in the center of base plate 67. Second end 64 of shaft 62 extends through a central hole 73 (FIG. 6) in planar portion 69 of bracket 40, and thus is accessible for rotation.

Base plate 67 of FIGS. 6 and 7 is positioned between support member 53 and a planar upper portion 69 of bracket 40. Base plate 67 is connected to planar portion 69 of bracket 40 by three screws 70. Below base plate 67, the shaft of each screw 70 is within a spring 71. Springs 71 provide compliance, allow for tolerance stacks, and are useful to withstand shock and vibration loads.

Referring to FIGS. 6 and 7, tongues 46 of U-shaped member 44 slide vertically within polycarbonate guides 72 (FIG. 7). Guides 72 are connected to opposite sides of bracket 40. Guides 72 engage tongues 46 and prevent rotation of U-shaped member 44 and beam 21. The slideable engagement of tongues 46 within guides 72 prevents rotation of beam 21, while allowing vertical motion to absorb shocks.

As previously mentioned, inner threads 51 (FIG. 6) of acorn nut 41 and upper first threads 65 of differential screw 42 (FIG. 7) are M4, and second threads 66 of differential screw 42 are M5 in this embodiment. Because the pitches of these threads differ (0.7 mm verses 0.8 mm), a rough adjustment of the height of beam 21 and rods 25 relative to platen 35 can be made by rotating acorn nut 41, and a fine adjustment can be made by rotating differential screw 42. One rotation of acorn nut 41 will raise or lower beam 21 a distance of 0.7 mm relative to fixed bracket 40 and platen 35. One rotation of differential screw 42 will raise or lower beam 21 a distance of 0.1 mm (0.8 mm minus 0.7 mm) relative to bracket 40 and platen 35. In alternative embodiments, the pitch of inner threads 51 of acorn nut 41 and/or second threads 66 of differential screw 42 can be varied so that different amounts of change can be made in the height of beam 21 and space 38.

Making a rough adjustment to the height of beam 21 at the point where an adjustment assembly 37 is located involves rotation of acorn nut 41. While ensuring that differential screw 42 does not rotate, acorn nut 41 is rotated counter clockwise to raise beam 21 relative to bracket 40 and platen 35, and rotated clockwise to lower beam 21. This method can be performed for each adjustment assembly 37 of printer 1 or for a selected number of adjustment assemblies 37, depending on whether an adjustment is necessary at that point along the length of beam 21. A laser gauge or other gauge is used to measure the height of space 38.

Making a fine adjustment to the height of beam 21 at the point where an adjustment assembly 37 is located involves rotation of differential screw 42. While ensuring that acorn nut 41 does not rotate, differential screw 42 is rotated counter clockwise (viewed from below) to lower beam 21 relative to bracket 40 and platen 35, and rotated clockwise to raise beam 21. This method can be performed for each adjustment assembly 37 that supports beam 21 or for a selected number of adjustment assemblies 37, depending on whether an adjustment is necessary at that point along the length of beam 21. A typical situation may require both a rough and a fine adjustment of the height of beam 21 at the location of each adjustment assembly 37.

After the space 38 is set, a printing method includes feeding a print media, such as paper 36 of FIG. 5, through space 38 between printheads 4 and platen 35. Ink is ejected from printheads 4 onto the print media as carriage 3 moves printheads 4 along rods 27 according to information input from, for example, a computer connected to printer 1.

The embodiments described herein are merely examples of the present invention. Artisans will appreciate that variations are possible within the scope of the claims.

I claim:

1. A printer comprising:

at least one printhead and a platen, wherein a first space is between the at least one printhead and the platen;

a first adjustment, wherein actuation of the first adjustment adjusts said first space; and a second adjustment, wherein actuation of the second adjustment adjusts said first space and said second adjustment adjusts said first space relatively finer than said first adjustment.

2. The printer of claim 1, wherein at least one of said first and second adjustments is a nut.

3. The printer of claim 1, wherein at least one of said first and second adjustments is a differential screw.

4. The printer of claim 1, wherein the first adjustment is a nut and the second adjustment is a differential screw engaged with said nut.

5. The printer of claim 1, wherein the first adjustment and the second adjustment have a common vertical axis.

6. The printer of claim 1, wherein the first and second adjustments actuate by rotation.

7. The printer of claim 1, further comprising at least one rod upon which a carriage travels, said carriage supporting said at least one printhead, and wherein actuation of the first and second adjustments move the rod relative to the platen.

8. The printer of claim 7, further comprising a beam that supports said at least one rod, wherein actuation of the first and second adjustments move the beam relative to the platen, and thereby moves the at least one rod.

9. The printer of claim 8, further comprising a plurality of adjustment assemblies beneath and along a length of said beam, each adjustment assembly comprises said first and second adjustments, and each adjustment assembly abuts a surface of said beam.

10. The printer of claim 9, wherein the adjustment assemblies further comprise vertically sliding members engaged with a guide.

11. The printer of claim 8, the first adjustment is a nut and the second adjustment is a differential screw engaged with said nut, and said nut is aligned with a centroid of the beam.

12. The printer of claim 1, further comprising a plurality of adjustment assemblies, wherein each adjustment assembly comprises said first and second adjustments.

13. The printer of claim 12, wherein the first adjustment is a nut and the second adjustment is a differential screw engaged with said nut.

14. In a printer including a carriage that moves at least one printhead laterally adjacent to a platen, wherein the at least one printhead and the platen define a space between them, an assembly for adjusting the space, the assembly comprising:

a first adjustment, wherein actuation of the first adjustment adjusts said space; and a second adjustment, wherein actuation of the second adjustment adjusts said space and said second adjustment adjusts said space relatively finer than said first adjustment.

15. The adjustment assembly of claim 14, wherein at least one of said first and second adjustments is a differential screw.

16. The adjustment assembly of claim 15, wherein the first adjustment is a nut and the second adjustment is a differential screw engaged with said nut.

17. The adjustment assembly of claim 14, wherein the first adjustment and the second adjustment have a common vertical axis.

18. The adjustment assembly of claim 14, wherein the first and second adjustments actuate by rotation.

19. In a printer including carriage that moves at least one printhead laterally adjacent to a platen, wherein the at least one printhead and the platen define a space between them, a method of adjusting the space comprising:

selectively actuating a first adjustment; and selectively actuating a second adjustment co-located with the first adjustment, wherein said second adjustment adjusts said space relatively finer than said first adjustment, whereby a desired spacing between the printhead and the platen is achieved.

20. The method of claim 19, wherein the first and second adjustments actuate by rotation.

21. The method of claim 19, wherein at least one of the first and second adjustments is a differential screw.

22. The method of claim 21, wherein the first adjustment is a nut and the second adjustment is a differential screw engaged with the nut.

23. The method of claim 19, further comprising preventing rotation of the guideway while actuating the first and second adjustments.

24. The method of claim 19, wherein the printer includes one or more rods upon which the carriage travels and a beam that supports said one or more rods, and actuation of the first and second adjustments applies a bending force to said beam and thereby adjusts the space.

25. The method of claim 24, further comprising selectively actuating a plurality of first adjustments and a plurality of second adjustments each co-located with a first adjustment.

26. A printer comprising:

at least one printhead and a platen, wherein a space is between the at least one printhead and the platen; and an adjustment assembly comprising a differential screw, wherein actuation of said differential screw adjusts said space.

27. The printer of claim 26, wherein the adjustment assembly includes a first adjustment and a second adjustment to adjust said space.

28. The printer of claim 27, wherein actuation of the second adjustment adjusts said space relatively finer than said first adjustment.

29. The printer of claim 27, wherein one of said adjustments is a nut.

* * * * *